US006290480B1

(12) United States Patent
Lifson

(10) Patent No.: US 6,290,480 B1
(45) Date of Patent: Sep. 18, 2001

(54) SCREW MACHINE

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/467,266

(22) Filed: Dec. 20, 1999

(51) Int. Cl.[7] ..... F03C 2/00
(52) U.S. Cl. ..... 418/141; 418/104; 418/201.1
(58) Field of Search ..... 418/104, 201.1, 418/141

(56) References Cited

U.S. PATENT DOCUMENTS

| | | | | |
|---|---|---|---|---|
| 2,492,935 | * | 12/1949 | McCulloch et al. | 418/141 |
| 2,849,988 | * | 9/1958 | Nilsson | 418/201.1 |
| 2,868,442 | * | 1/1959 | Nilsson | 418/201.1 |
| 3,557,687 | * | 1/1971 | Grinpress et al. | 418/201.1 |
| 3,902,827 | * | 9/1975 | Schibbye | 418/201.1 |
| 4,417,859 | * | 11/1983 | Praner | 418/141 |
| 5,290,150 | * | 3/1994 | Takahashi et al. | 418/201.1 |
| 5,310,320 | * | 5/1994 | Timuska | 418/152 |
| 5,772,418 | * | 6/1998 | Tateno et al. | 418/201.1 |
| 5,797,735 | * | 8/1998 | Ishikawa et al. | 418/201.1 |

FOREIGN PATENT DOCUMENTS

| | | | | |
|---|---|---|---|---|
| 2232592 | * | 1/1974 | (DE) | 418/141 |
| 2952240 | * | 7/1981 | (DE) | 418/141 |
| 56-018091 | * | 2/1981 | (JP) | 418/104 |
| 59-224402 | * | 12/1984 | (JP) | 418/141 |
| 03-290086 | * | 12/1991 | (JP) | 418/201.1 |
| 06-088581 | * | 3/1994 | (JP) | 418/201.1 |

* cited by examiner

*Primary Examiner*—Thomas Denion
*Assistant Examiner*—Theresa Trieu
(74) *Attorney, Agent, or Firm*—William W. Habelt

(57) ABSTRACT

A screw machine (10) has a rotor housing (12) defining overlapping bores (13, 15). Female rotor (14) is located in bore (13) and male rotor (16) is located in bore (15). Either or both of the facing surface (51) of the outlet casing (53) or the end faces (24, 26) of the female and male rotors, respectively, has a surface formed by a plurality of discrete cavities (70) separated by a network of interconnected wall members (80).

3 Claims, 5 Drawing Sheets

SCREW MACHINE

BACKGROUND OF THE INVENTION

In a conventional screw machine, a male rotor and a female rotor, disposed in respective parallel overlapping bores defined within a rotor housing, coact to trap and compress volumes of gas. While such two rotor configurations are the most common design, screw machines are also known in the art having three, or more, rotors housed in respective overlapping bores so as to coact in pairs. Paired male and female rotors differ in their lobe profiles and in the number of lobes and flutes. For example, the female rotor may have six lobes separated by six flutes; the while conjugate male rotor may have five lobes separated by five flutes. Accordingly, each possible combination of lobe and flute coaction between the rotors occurs on a cyclic basis.

The rotors of a typical screw machine are mounted in bearings at each end so as to provide both radial and axial restraint. Nevertheless, in conventional practice, a certain amount of clearance in the axial direction must be provided between the end face of the rotors and the facing surface of the housing. The need to provide an end running clearance is primarily the result of thermal growth of the rotors as a result of gas being heated in the compression process. Maintaining the desired end running clearance at an amount sufficient to ensure that contact does not occur between the end face of the rotors and the facing surface of the housing is important to reliable operation of the screw machine. Additionally, during operation, the pressure gradient in the fluid being compressed normally acts on the rotors in an axial direction tending to force the rotors toward the suction end of the screw machine, thereby tending to increase the end running clearance.

If the end running clearance is too large, excessive circumferential and radial leakage of compressed fluid may occur through the running clearance at the discharge end of the screw machine thereby significantly decreasing the overall efficiency of the screw machine. In conventional oil-flooded screw machines, it is customary to supply oil to the interface zone defined by the end running clearance between the rotor end faces and the housing end plate as a means of providing a fluid seal to reduce gas leakage through the interface zone. However, as the end running clearance is reduced, efficiency losses due to viscous friction forces in the oil between the rotor end faces and the housing end plate tend to increase.

As noted previously, in operation the rotors grow in the axial direction toward the end casing at the discharge end of the housing due to thermal growth resulting from the fluid being heated in the compression process. This thermal growth of the rotors tends to reduce the end-running clearance. However, during operation the aforenoted axial pressure gradient tends to push the rotors in an axial direction towards the suction end of the screw machine, thereby tending to increase the end running clearance.

Therefore, in conventional oil-flooded screw machines, it is customary to maintain a substantial amount of end running clearance to minimize friction losses and, in the extreme, to prevent failure from rotor seizure. Such seizure may be a result of the thermal growth of the rotor due to the compression process. Also, as the end running clearance decreases, the viscous friction forces increase and may cause reduction in compressor operating efficiency.

As noted previously, the penalty for maintaining a large end running clearance is a consequent increase in leakage of compressed fluid. In order to maintain a large end running clearance in conventional oil-flooded screw compressors, it is known to add material to the end face of the rotors to provide a physical barrier to circumferential gas leakage. For example, elongated bar strips have been welded to rotor end faces so as to extend radially along the centerline of the lobes or lands of the rotors thereby extending across and bridging a substantial portion of the end-running clearance.

SUMMARY OF THE INVENTION

It is an object of this invention to improve operating efficiency in a screw machine.

It is another object of this invention to reduce rotor end-running clearance leakage in a screw machine.

In the screw machine of the present invention, the leakage of compressed gas through the end-running clearance of a screw compressor is reduced by providing a continues expansion and contraction path to leakage gas through the end-running clearance. In one embodiment of the present invention, the surface of the rotor end faces and/or the facing surface of the end plate of the housing comprises a surface of small discrete cavities separated by the respective cavity wall structure in honeycomb-like fashion, that is separated by a network of interconnected wall members. In traversing such as surface, the leakage gas must repeatedly expand and contract as it passes over cavities and the cavity walls, a process which acts to reduce leakage flow. Unlike conventional labyrinth seals which provide sealing in only one direction and can actually result in increase of circumferential leakage through the grooves formed by labyrinth seal, the honeycomb-like pattern cavity structure of the surface provides effective sealing against both radial and circumferential gas leakage.

The present invention is especially important for screw machines operating with reduced amount of circulating oil. In these machines it is more difficult to achieve good leakage control due to insufficient amount of oil sealing the leakage path.

BRIEF DESCRIPTION OF THE DRAWINGS

For a fuller understanding of the present invention, reference should now be made to the following detailed description of various embodiments thereof and to the accompanying drawings wherein.

DESCRIPTION OF THE PREFERRED EMBODIMENTS

Figure 1:
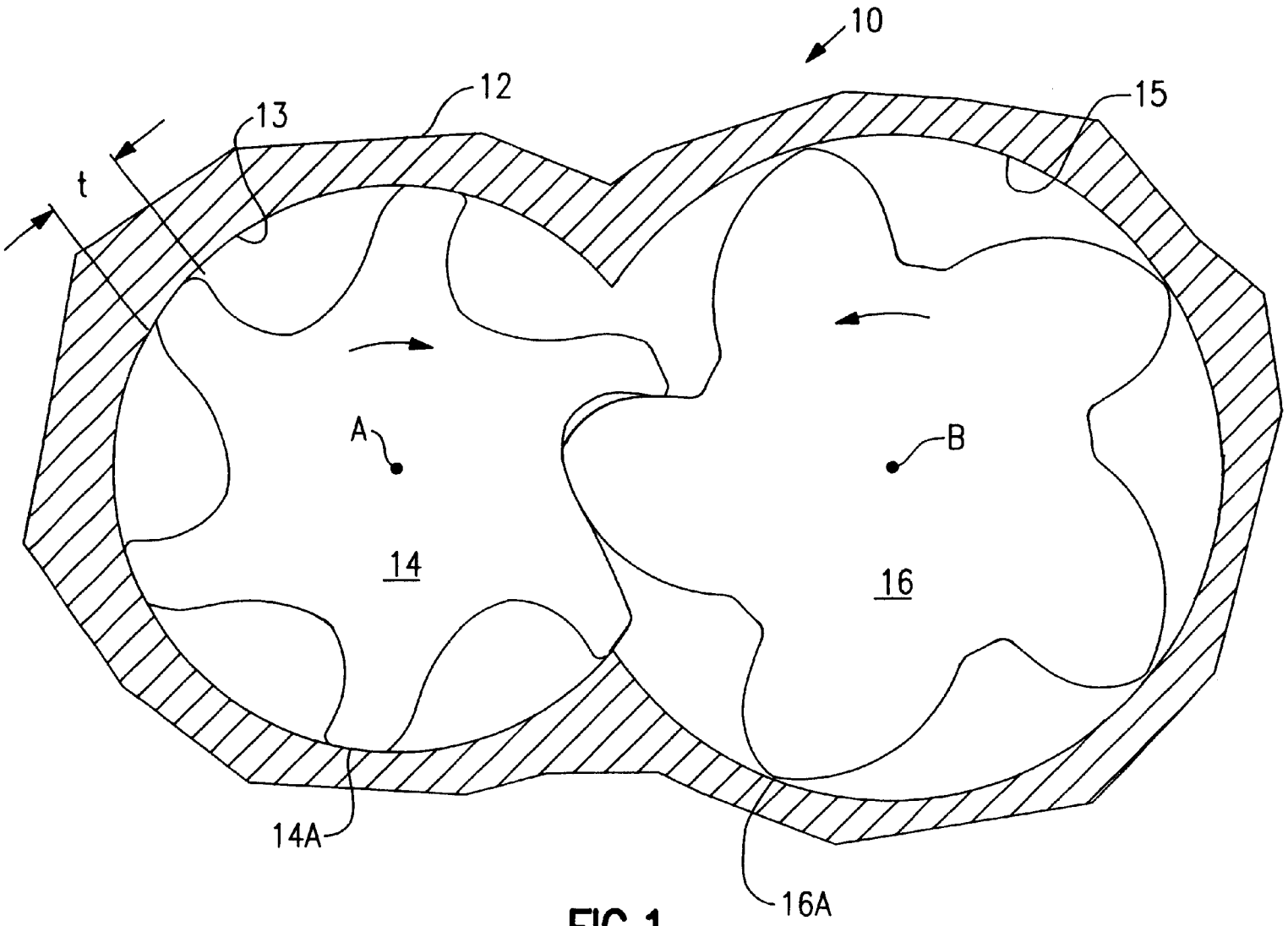
FIG. 1 is a transverse section through a screw machine.

Referring now to FIG. 1, there is depicted a screw machine 10, such as a screw compressor, having a rotor housing or casing 12 with a pair of overlapping bores 13 and 15 located therein. Female rotor 14 is located in bore 13 and male rotor 16 is located in bore 15. The bores 13 and 15 generally extend along parallel axes, A and B, respectively.

In the illustrated embodiment, female rotor 14 has six lobes 14A separated by six flutes, while male rotor 16 has five lobes separated by five flutes. Either the female rotor 14 or the male rotor 16 may be connected to a prime mover (not illustrated) and serve as the driving rotor. Other combinations of the number of female and male lobes and flutes may also be used.

Figure 2:
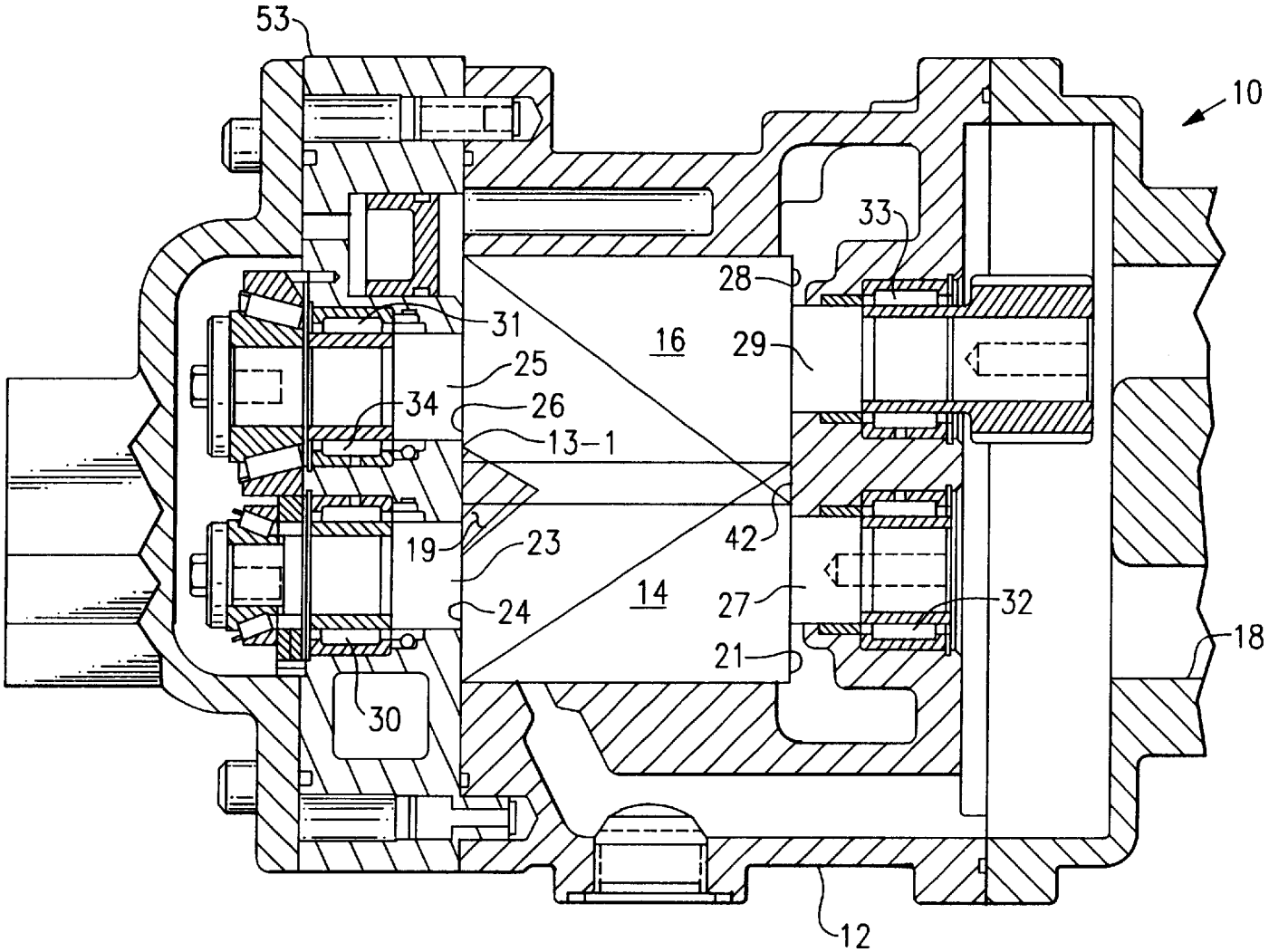
FIG. 2 is a partially sectioned view of the screw machine of FIG. 1.
Figure 3:
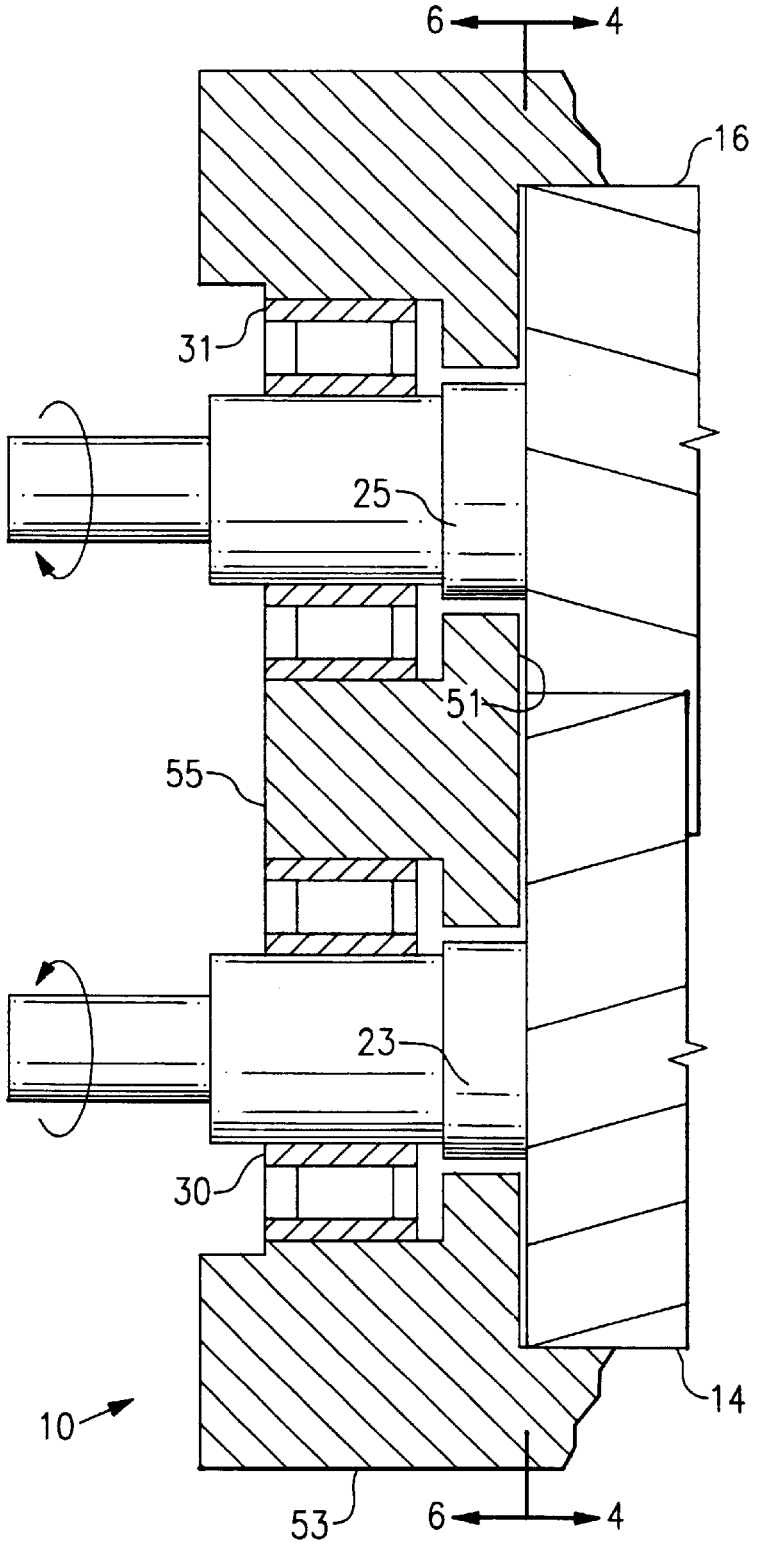
FIG. 3 is an enlarged view of a portion of the discharge end of the screw machine of FIG. 1.

Referring now to FIGS. 2 and 3, rotor 14 has a shaft portion 23 with an end face 24 formed on the end of the rotor 14 radially outward of the shaft portion 23. Shaft portion 23 of rotor 14 is supported in outlet or discharge casing 53 by one, or more, bearing(s) 30. Similarly, rotor 16 has a shaft portion 25 with an end face 26 formed on the end of the rotor 16 radially outward of the shaft portion 26. Shaft portion 25 of rotor 16 is supported in outlet casing 53 by one, or more bearing(s) 31. Suction side shaft portions 27 and 29 of rotors 14 and 16, respectively, are supportingly received in rotor housing 12 by roller bearings 32 and 33, respectively.

In operation, for example as a refrigerant compressor, assuming male rotor 16 to be the driving rotor, rotor 16 rotates engaging rotor 14 and causing its rotation. The coaction of rotating rotors 14 and 16, disposed within the respective bores 13 and 15, draws refrigerant gas via suction inlet 18 into the grooves of rotors 16 and 14 which engage to trap and compress volumes of gas and deliver the hot compressed gas to discharge port 19. For the reasons discussed hereinbefore, it is necessary to maintain an end-running clearance 60 between the end faces 24 and 26 at the discharge ends of the rotors 14 and 16, respectively, and the facing surface 51 of the end plate 55 of outlet casing 53. This end running clearance 60 is defined as the region between the closest interface surfaces of the rotor end faces 24 and 26 and the facing surface 51 of the end plate 55. This end running clearance 60 establishes a potential gas leakage path, both circumferential and radial, between rotor end faces 24 and 26 and the end plate 55 of the outlet casing 53. As in conventional oil-flooded compressors, lubrication oil that naturally flows into the end-running clearance 60 serves as a seal to reduce gas leakage through the end-running clearance.

Figure 4:
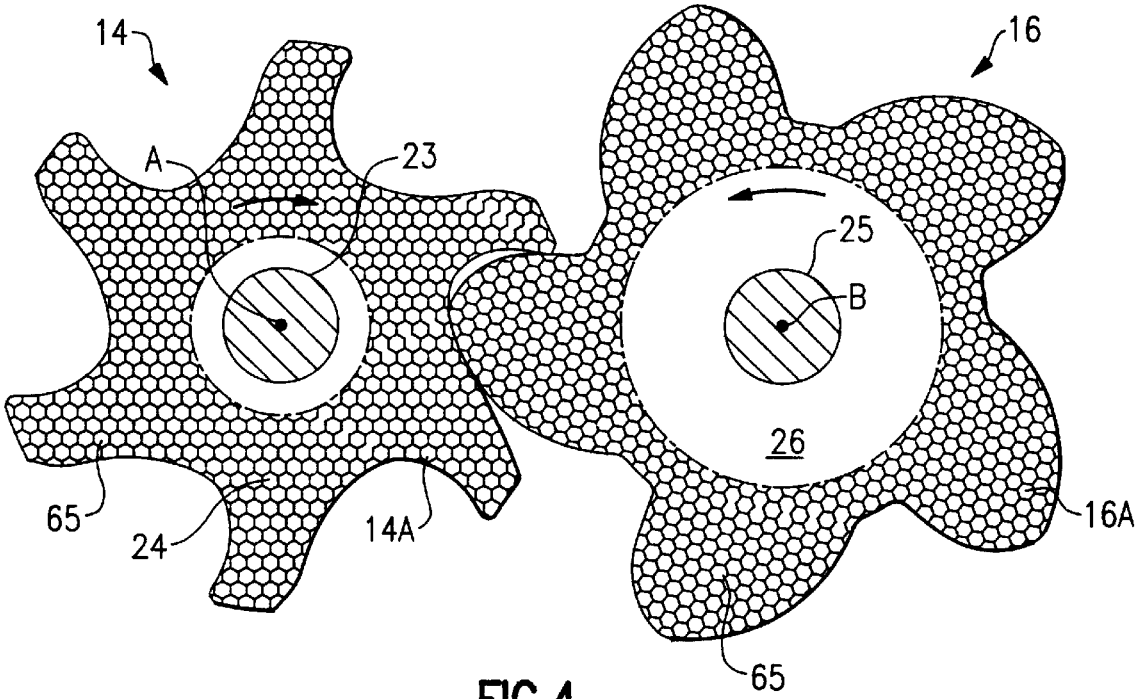
FIG. 4 is an end view of the rotors taken along line 4—4 of FIG. 3 showing one embodiment of the end faces of the rotors.
Figure 5:
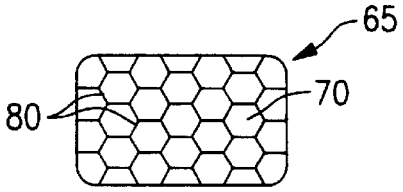
FIG. 5 is an enlarged view of a particular embodiment of honeycomb-like surface structure.

In the screw machine of the present invention, the leakage of compressed gas through the end-running clearance of a screw compressor is reduced by providing a tortuous leakage path, where continuous expansion and contraction takes place, through the end-running clearance. In the embodiment of the present invention depicted in FIG. 4, the surface of the rotor end faces 24 and 26 comprises a honeycomb-like surface 65. As depicted in FIG. 5, the surface 65 comprises a plurality of small discrete cavities 70 separated by the respective cavity wall members 80. In traversing end-running clearance 60, the leakage gas must past over the honeycomb-like surface 65 on the rotor faces 24 and 26. In so doing, the leakage gas flow repeatedly expands and contracts as it passes over cavities and the cavity walls, a process which acts to reduce leakage flow.

Figure 6:
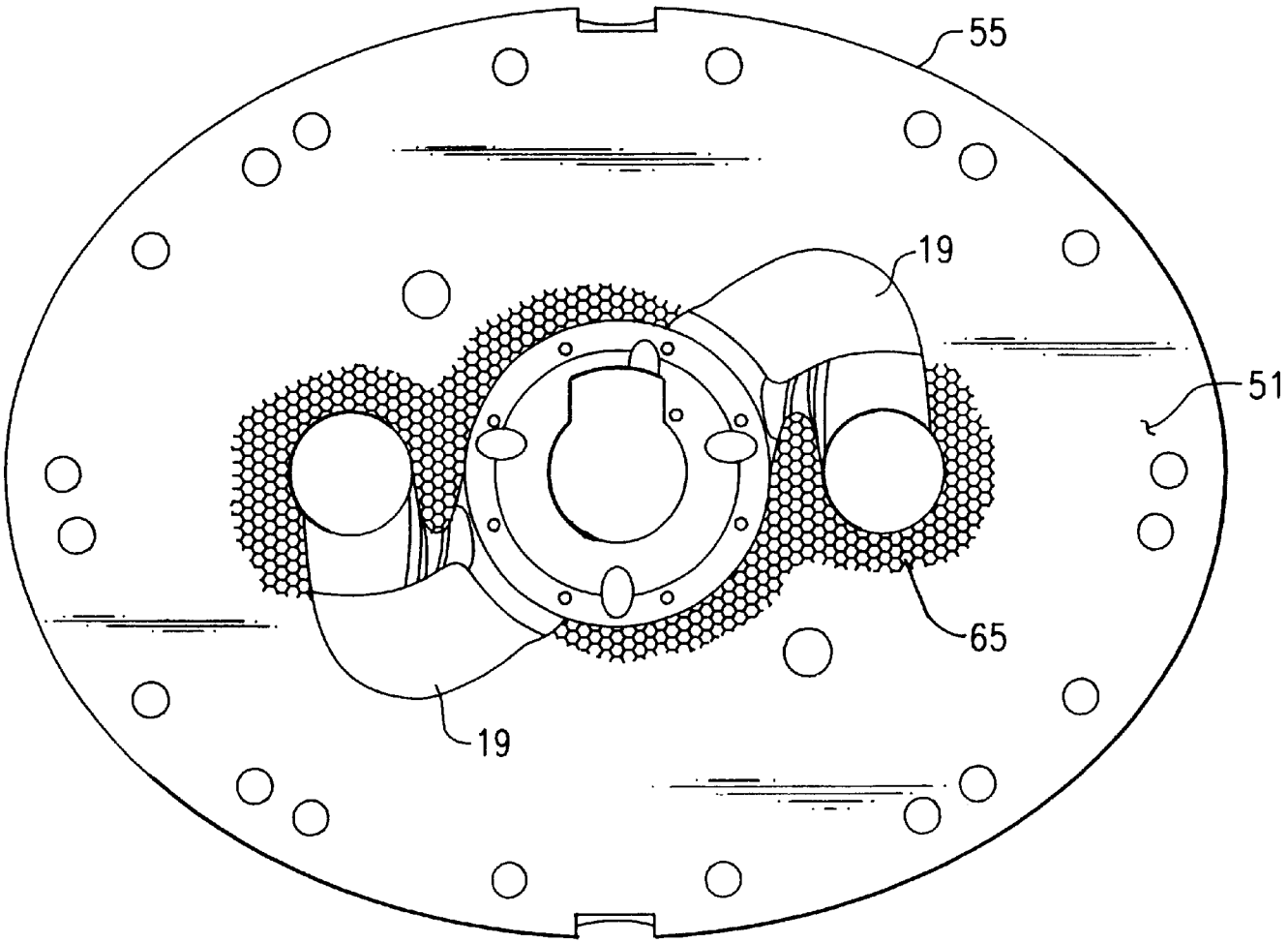
FIG. 6 is an end view of the end plate of the housing taken alone line 6—6 of FIG. 3 showing an alternate embodiment of the present invention.

In the embodiment of the present invention illustrated in FIG. 6, the facing surface 51 of the end plate 55 of the outlet casing 53 comprises a honeycomb-like surface 65, which as depicted in FIG. 5, comprises a plurality of small discrete cavities 70 separated by the respective cavity wall members 80. In traversing end-running clearance 60, the leakage gas must past over the honeycomb-like surface 65 on the facing surface 51 of the end plate 55 of the outlet casing 53. In so doing, the leakage gas flow repeatedly expands and contracts as it passes over cavities 70 and the cavity wall members 80, a process which acts to reduce leakage flow.

Unlike conventional labyrinth seals that provide sealing in only one direction, the honeycomb-like pattern cavity structure of the surface provides effective sealing against both radial and circumferential gas leakage. It is to be understood that honeycomb-like structure refers to a plurality of discrete open cavities 70 separated by a network of interconnected wall members 80. It is not necessary that the cavities actually resemble hexagonal cells of the type associated with honeycombs. Neither the depth, the shape nor the size of the open area of the cavities 70 are critical to the invention, but rather are a matter of design choice.

Although the present invention has been specifically illustrated and described in terms of a twin rotor screw machine, it is applicable to screw machines employing three, or more rotors. Therefore, the present invention is intended to be limited only by the scope of the appended claims.

What is claimed is:

1. A screw machine comprising a housing defining at least one pair of parallel, overlapping bores, an outlet casing having a facing surface, and a conjugate pair of intermeshing rotors located in said at least one pair of bores, each of said rotors having an end face, said end faces of said rotors being spaced from said facing surface of the outlet casing and defining therewith an end-running clearance; characterized in that the surface of at least either said rotor end faces or said facing surface of the outlet casing comprises a plurality of discrete cavities separated by a network of interconnected wall members.

2. The screw machine of claim 1 wherein said plurality of discrete cavities separated by a network of interconnected wall members is formed on each of said rotor end faces.

3. The screw machine of claim 1 wherein said plurality of discrete cavities separated by a network of interconnected wall members is formed on the facing surface of the outlet casing.

* * * * *